United States Patent [19]

Strom

[11] 4,236,336

[45] Dec. 2, 1980

[54] NOTIONS DISPLAY HEADING FOR PERFORATED BOARD

[75] Inventor: Robert Strom, Queens, N.Y.

[73] Assignee: Textron Inc., Providence, R.I.

[21] Appl. No.: 973,363

[22] Filed: Dec. 26, 1978

[51] Int. Cl.[3] ..... G09F 7/06

[52] U.S. Cl. ..... 40/622; 40/10 R

[58] Field of Search ..... 40/124, 124.4, 622, 40/618, 616, 10 R

[56] References Cited

U.S. PATENT DOCUMENTS

| | | | |
|---|---|---|---|
| 2,814,894 | 12/1957 | Horton | 40/489 |
| 3,479,079 | 2/1970 | Kulwiec | 40/618 X |
| 3,358,395 | 12/1967 | Simonovic | 40/489 |
| 3,590,507 | 7/1971 | Wren | 40/618 X |

*Primary Examiner*—Robert Peshock
*Assistant Examiner*—Wenceslao J. Contreras
*Attorney, Agent, or Firm*—O'Brien & Marks

[57] ABSTRACT

A display heading for notions is particularly designed for use with a perforated board support that is utilized to merchandise a plurality of notions in sets of common series or groups. The notions display heading is made of plastic with rear-surface fasteners having hook like elements that project through selected apertures in the perforated board support.

4 Claims, 3 Drawing Figures

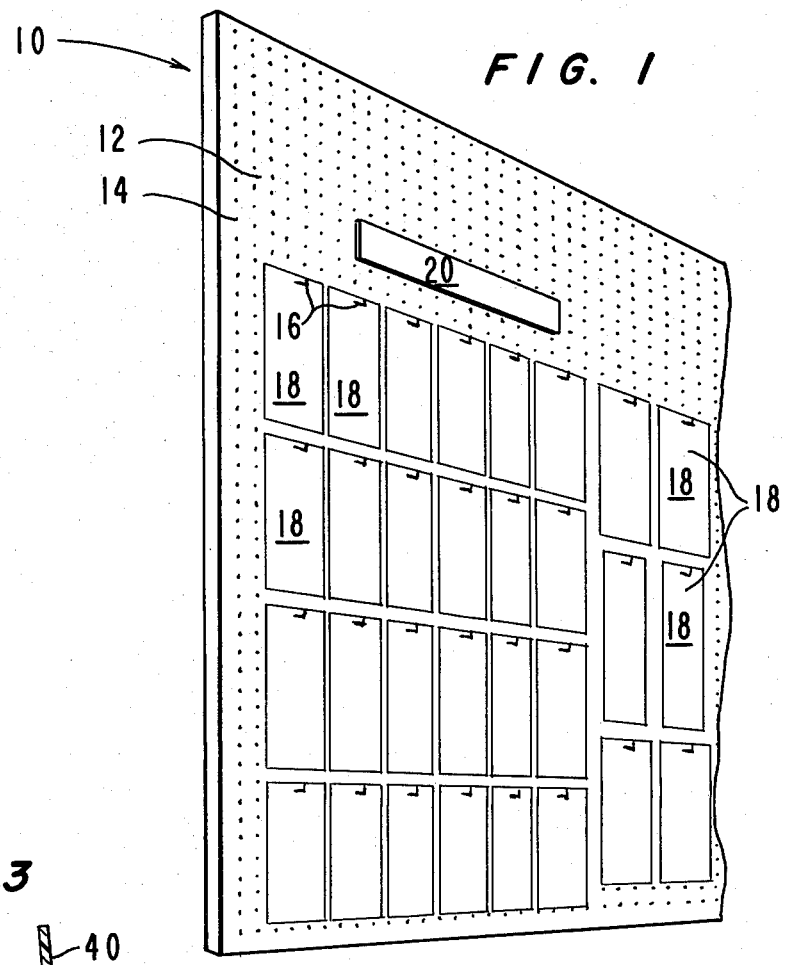
FIG. 1
FIG. 3
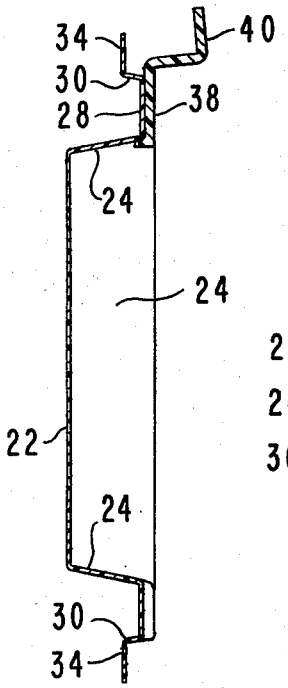
FIG. 2
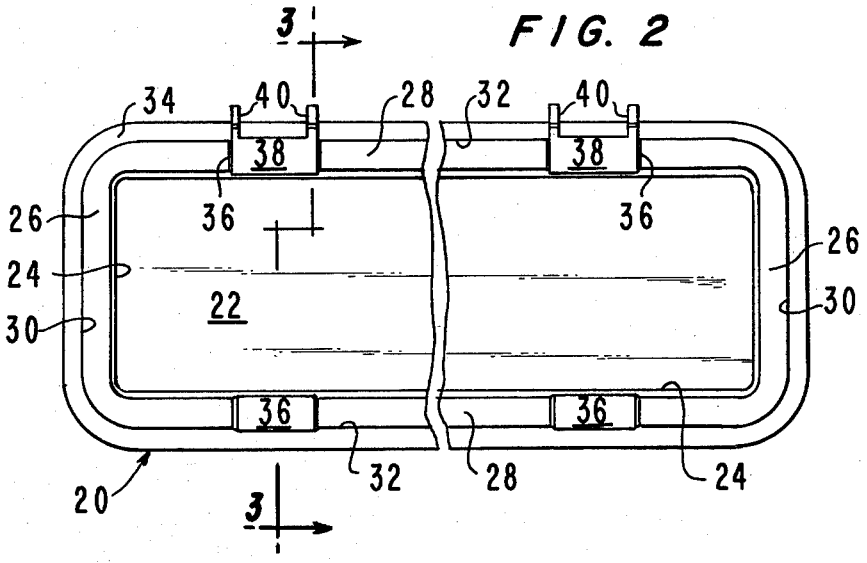

NOTIONS DISPLAY HEADING FOR PERFORATED BOARD

BACKGROUND OF THE INVENTION

1. Field of the Invention

The present invention relates to a perforated board wall merchandise displays and particularly to indicia-containing notions display heading for grouping a particular type or series of notions.

2. Description of the Prior Art

A wide variety of display devices, and particularly, peg-board displays are well known in the art. One example of an indicia forming pegboard display is described in U.S. Pat. No. 412,972. Another example of a peg-board display is shown in U.S. Pat. No. 3,089,269.

SUMMARY OF THE INVENTION

The present invention is limited to a perforated board notions display heading which includes a plurality of support members provided with extensions that are spaced to correspond to the conventional spacing of perforated board apertures, a facing panel which has notion indicia thereon, and abutment surfaces to space the facing panel from the peg-board.

An object of the invention is to construct a notions display heading which can be easily attached to a perforated board display.

Another object of the invention is to construct a notions display heading which can be economically manufactured and easily replaced.

Other objects, features, and advantages will become apparent from the following description when taken in conjunction with the accompanying drawing.

BRIEF DESCRIPTION OF THE DRAWING

FIG. 1 is a partial isometric view of a wall mounted notions device embodying the present invention.

FIG. 2 is a rear elevation view of a detail of FIG. 1.

FIG. 3 is a cross-sectional view taken along the offset line 3—3 of FIG. 2.

DESCRIPTION OF THE PREFERRED EMBODIMENT

A wall mounted display, indicated generally at 10 in FIG. 1, includes a conventional perforated board support 12 having an array of uniformly spaced apertures 14. A plurality of conventional perforated board mounting brackets 16 cooperate with the apertures 14 to provide hanging means for merchandise display cards 18 which consist of a variety of articles usually sold only at the notions counter.

A notions display heading 20 made of any suitable plastic material, is mounted above a series of the cards 18 to indicate a group title or identification for such series. Such notions include thread, scissors, sewing aides, etc.

The display heading 20 as shown in FIG. 2, has a generally rectangular facing panel 22 which has any suitable indicia on the front surface thereof. The facing panel 22 has four sides 24 terminating in a generally rectangular planar surface defined by a pair of spaced end abutment surfaces 26 joined by upper and lower abutment surfaces 28 to define a rectangular perimeter around the sides 24. As is shown in FIG. 3, the four sides 24 are formed to slope slightly from the edges of the facing panel 22 to the edges of the surfaces 26 and 30; thus the indicia bearing panel 22 will project forwardly from the perforated board support 12 when mounted thereon. The surfaces 26 are bound on their opposite sides by side walls 30. The surfaces 28 are also bound on their opposite sides by side walls 32 which are joined to side walls 30. A peripheral flange 34 is integrally connected to the outer edges of the side walls 32 and 34.

The upper and lower surfaces 28 are provided with a plurality of recessed areas 36 (see FIG. 2) which are sized to receive attachment or fastening members 38. The attachment members 38, which are also made of plastic, are fixedly secured to the areas 36 by adhesive or other suitable means. Each member 38 is provided with a hook member in the form of a pair of L-shaped extensions 40 adjacent their lateral edges. The extensions 40 are spaced so as to correspond to the aperture spacing of the perforated board support 12 and project in such a manner that when the member 38 is affixed to the area 36, the base of the L is substantially parallel to the facing panel 22 and to the surfaces 26 and 28.

As is apparent from FIG. 2, the recesses 36 are located in both the upper and lower rear surfaces 28 of the display heading 20. This arrangement permits the use of four attachment members 38 as when the display heading is exceptionally large.

Flexibility of the plastic display heading permits use of attachment members 38 along the lower rear surface 28 as well as along the upper rear surface 28. Because the attachment members 38 are fastened in the recesses 36, the peripheral side walls of the display heading 20 are always substantially flush or in surface to surface contact with the perforated board 12. In the embodiment shown in FIG. 2, two areas 36 are shown on each surface 28 and support members 38 are shown affixed to only the areas 36 in the upper surface 38. However, a plurality of more than two areas 36 may be utilized with a similar plurality of attachment members.

The display heading 20 in the preferred embodiment is secured to a perforated board panel 12 by inserting the base 5 of the L projections 40 into corresponding apertures 14 on the perforated board support 12. The panel 22 is then brought down in a circular fashion until the lower surface 28 abuts the panel 12. The downward rotation causes the bases of the projections 40 to move through the apertures and vertically lock in place behind the panel 12.

The above arrangement has the particular advantage of providing a perforated board support with a simple label bracket which does not require any special fastening means and which may be located anywhere on the perforated board support to fulfill its function as a display heading identifying a series of articles mounted below the display heading on the same perforated board support. It is not necessary to make a prior layout of the mounted articles in order to locate the display heading thereon because with the present invention, the display heading is universally mountable. Thus the notions display heading may even be relocated after several articles have been removed.

Inasmuch as the present invention is subject to many modifications, changes and reversal of parts, it is intended that all matter contained in the foregoing description or on the accompanying drawing be interpreted as illustrative and not in a limiting sense.

What is claimed is:

1. A notions device comprising:

a display heading surface adapted to receive identifying indicia thereon relating to articles sold on a notions counter, peripheral sides extending rearwardly from said display heading surface, an abutting surface extending perpendicularly outwardly from said peripheral sides to define a mounting surface spaced from said display heading surface, a plurality of spaced recesses in said abutting surface, a perforated board having a plurality of spaced apertures therethrough, and a plurality of fastening elements respectively secured to said plurality of spaced recesses, each fastening element having hook members projecting through selected apertures on said perforated board whereby said recesses permit flush mounting between said abutting surface and said perforated board with said display heading surface being spaced from said perforated board.

2. The invention of claim 1 wherein each fastening element comprises a flat surface contacting its corresponding recess on said abutting surface.

3. The invention as recited in claim 2 wherein adhesive means secures the flat surface of said fastening element to its corresponding recess.

4. The invention as recited in claim 3 wherein each hook member includes a pair of L-shaped extensions with first legs integrally extending from its fastening element and a second legs projecting through a selected pair of apertures in said perforated board.

* * * * *